Fig. 1
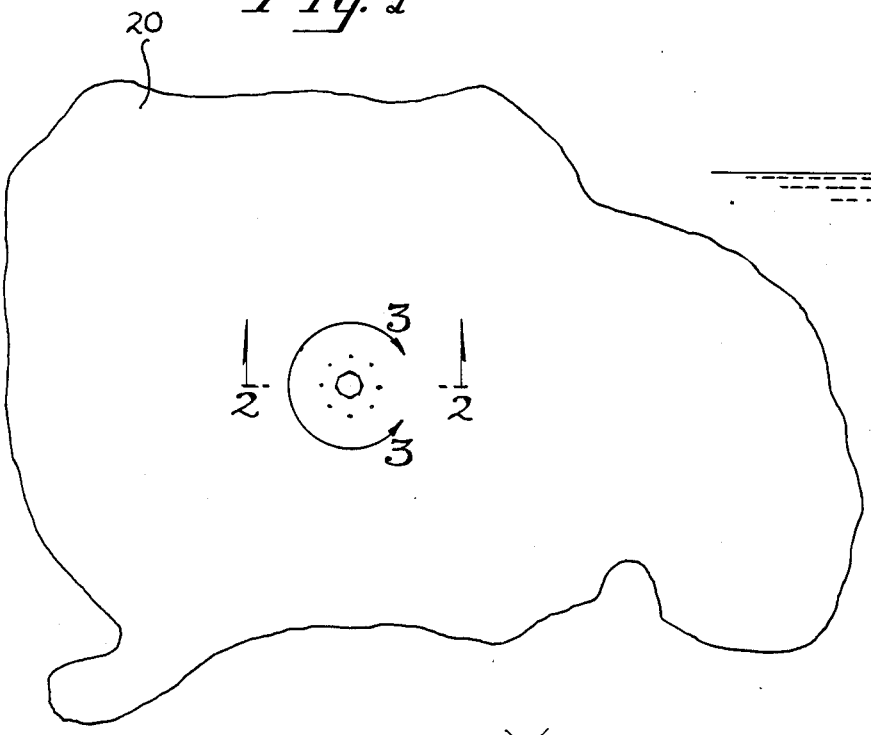
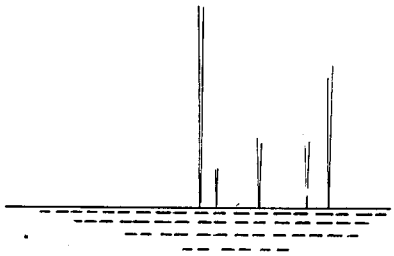
Fig. 2
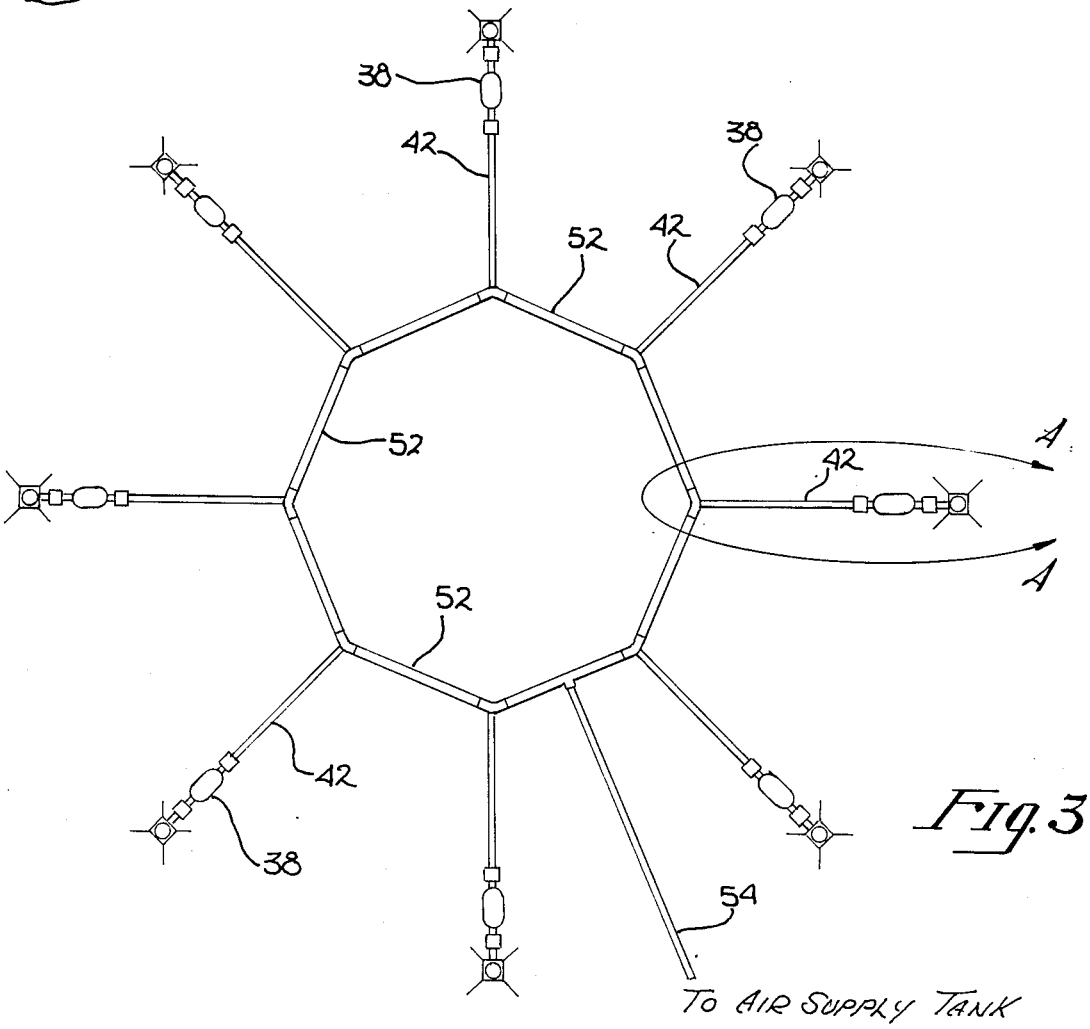
Fig. 3

United States Patent [19]

Fuller et al.

[11] Patent Number: 4,852,801

[45] Date of Patent: Aug. 1, 1989

[54] AIRPOWERED WATER DISPLAYS

[75] Inventors: Mark W. Fuller, Studio City; Alan S. Robinson, El Monte, both of Calif.

[73] Assignee: Wet Enterprises, Inc., Universal City, Calif.

[21] Appl. No.: 166,998

[22] Filed: Mar. 11, 1988

[51] Int. Cl.[4] ..... B05B 1/08; B05B 17/08

[52] U.S. Cl. ..... 239/12; 239/23; 239/101

[58] Field of Search ..... 239/16–18, 239/22, 20, 23, 99, 101, 12

[56] References Cited

U.S. PATENT DOCUMENTS

| | | | |
|---|---|---|---|
| 151,003 | 5/1874 | Briesen | 239/22 |
| 2,614,377 | 11/1952 | Wilson et al. | 239/17 |
| 2,868,055 | 1/1959 | Simos | 239/16 |
| 3,484,045 | 12/1969 | Waters | 239/22 |
| 3,684,175 | 8/1972 | Hruby | 239/22 |
| 3,722,819 | 3/1973 | Hall et al. | 239/99 |
| 4,270,697 | 6/1981 | Georgiev et al. | 239/99 |

FOREIGN PATENT DOCUMENTS

| | | | |
|---|---|---|---|
| 1228804 | 5/1986 | U.S.S.R. | 239/99 |
| 13526 | of 1884 | United Kingdom | 236/22 |

*Primary Examiner*—Andres Kashnikow
*Assistant Examiner*—Kevin P. Weldon
*Attorney, Agent, or Firm*—Blakely, Sokoloff, Taylor & Zafman

[57] ABSTRACT

Airpowered water displays for generating transient water displays which may have variable and high energy content are disclosed. In one form, a cylindrical chamber with a nozzle at one end thereof is disposed within a pool or lake so that the tip of the nozzle is substantially flush with the top of the water. Coupled to the lower part of the cylindrical chamber through a solenoid valve is a compressed air tank which, between firings, is filled with compressed air at a pressure selected in accordance with the height of the water display desired, with the pressure being varied between firings, such as by way of computer control. Opening of the solenoid valve couples the high pressure air to the bottom of the water column in the cylindrical chamber, forcing most of the water therein upward through the nozzle to heights which may reach one hundred fifty feet or more, dependent upon the pressure. Between firings, the cylindrical chamber is automatically refilled by the surrounding water. Various embodiments, including a lighted embodiment are disclosed.

18 Claims, 6 Drawing Sheets

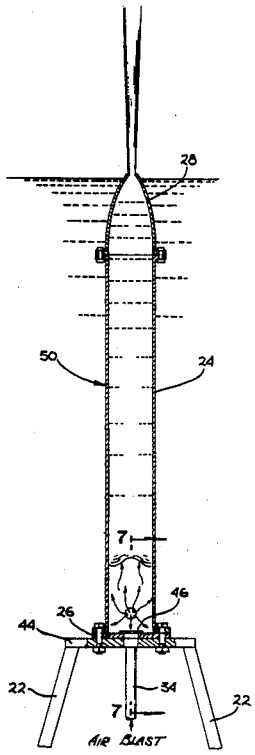

28
50
24
7
46
26
44
22
34
7
AIR BLAST
22

32
24
46
48
26
44

8
8
32
48
24
46
34
26
44
22

REFILL HOLE & VALVE

AIRPOWERED WATER DISPLAYS

BACKGROUND OF THE INVENTION

1. Field of the Invention.

The present invention relates to the field of water displays.

2. Prior Art.

Water displays ranging from simple fountains to complex time varying and lighted water displays are known in the prior art. Most water displays operate in conjunction with a fountain pool of some form to which the water in the displays returns for recirculation in the display. Also, while a non-varying display can be both very pleasing in appearance and soothing in sound, time varying displays have gained increasing popularity, probably because of the observer attention required, and almost demanded by the display, for the observer to experience and appreciate all the variations of the display. In conventional, relatively small displays, the problem of creating a dynamic or time varying display tends to center around one's ability to control the variations desired, wherein in large displays, the technical problems include not only control, but also absolute power requirement and the ability to vary such high power levels. By way of example, a water display to be created anywhere but at the very edge of a large pond or small lake will require very high instantaneous power levels if the water display is not to be dwarfed by the sheer size of the body of water. Accordingly, the simple and efficient creation of water displays for such applications is one of the objectives of the present invention.

With respect to the known prior art, U.S. Pat. No. 914,419 discloses a small automatic fountain which comprises a reservoir containing the fountain liquid and air under pressure, the air causing ejection of the liquid through a nozzle at the top of the fountain. To facilitate the varying pressure of the air as it expands during ejection of the water, an automatic valve arrangement is provided so that a substantially constant pressure is provided to the fountain nozzle. The fountain is intended to operate on a substantially continuous basis, requiring venting of the pressure chamber before more water can be added. Although such fountains should operate as intended, they are not suitable for use as a high energy transient display, as turning the display on and off would require on/off valving of the water flow in the presence of a high pressure, and of course would require periodic venting and refilling of the reservoir with water. Also, because of the size of the reservoir in comparison to the size of the cylindrical chamber through which the water is ejected, a particularly large control reservoir would be required where high energy, high water flow rate displays are desired.

Other displays are known which are steam powered, such as those disclosed in U.S. Pat. Nos. 1,066,565 and 3,484,045. Such displays are transient displays which operate in a regular pattern and are not controllable in the height of the display or period between operation thereof.

BRIEF SUMMARY OF THE INVENTION

Airpowered water displays for generating transient water displays which may have variable and high energy content are disclosed. In one form, a cylindrical chamber with a nozzle at one end thereof is disposed within a pool or lake so that the tip of the nozzle is substantially flush with the top of the water. Coupled to the lower part of the cylindrical chamber through a solenoid valve is a compressed air tank which, between firings, is filled with compressed air at a pressure selected in accordance with the height of the water display desired, with the pressure being varied between firings, such as by way of computer control. Opening of the solenoid valve couples the high pressure air to the bottom of the water column in the cylindrical chamber, forcing most of the water therein upward through the nozzle to heights which may reach one hundred fifty feet or more, dependent upon the pressure. Between firings, the cylindrical chamber is automatically refilled by the surrounding water. Various embodiments, including a lighted embodiment are disclosed.

BRIEF DESCRIPTION OF THE DRAWINGS

FIG. 1 is a top view of a typical installation of the present invention in a pond or lake.

FIG. 2 is a view taken along line 2—2 of FIG. 1 illustrating typical variations in the water stream emitted by the water display of FIG. 1 whether the water ejectors are simultaneously fired or fired in some type of sequence.

FIG. 3 is a view taken on an expanded scale along line 3—3 of FIG. 1.

DETAILED DESCRIPTION OF THE INVENTION

First referring to FIG. 1, a top view of a small lake 20 having one embodiment of the present invention therein may be seen. In this embodiment, a plurality of upward directed nozzles direct a plurality of water streams upward from the surface if the lake, namely, eight such streams in the embodiment shown. Typical streams which may be emitted are illustrated in FIG. 2, through as shall subsequently be seen, not only may the streams be of differing heights, but in general they will not only be transient streams, but may also be staggered in time as desired. In one embodiment, the water streams are approximately 3 inches in diameter, and depending upon the air pressure used to power the same, may extend upward to 150 feet or more. While any one stream will have a duration on the order of 2 seconds, such time period is sufficiently long to capture the interest of an observer, particularly considering the magnitude of and energy in the display. In that regard, while much smaller displays may also be created using the principles of the present invention, one of the unique capabilities of the present invention is to provide large displays useable in conjunction with lakes and other bodies of water which would dwarf more conventional water displays.

Figure 5:
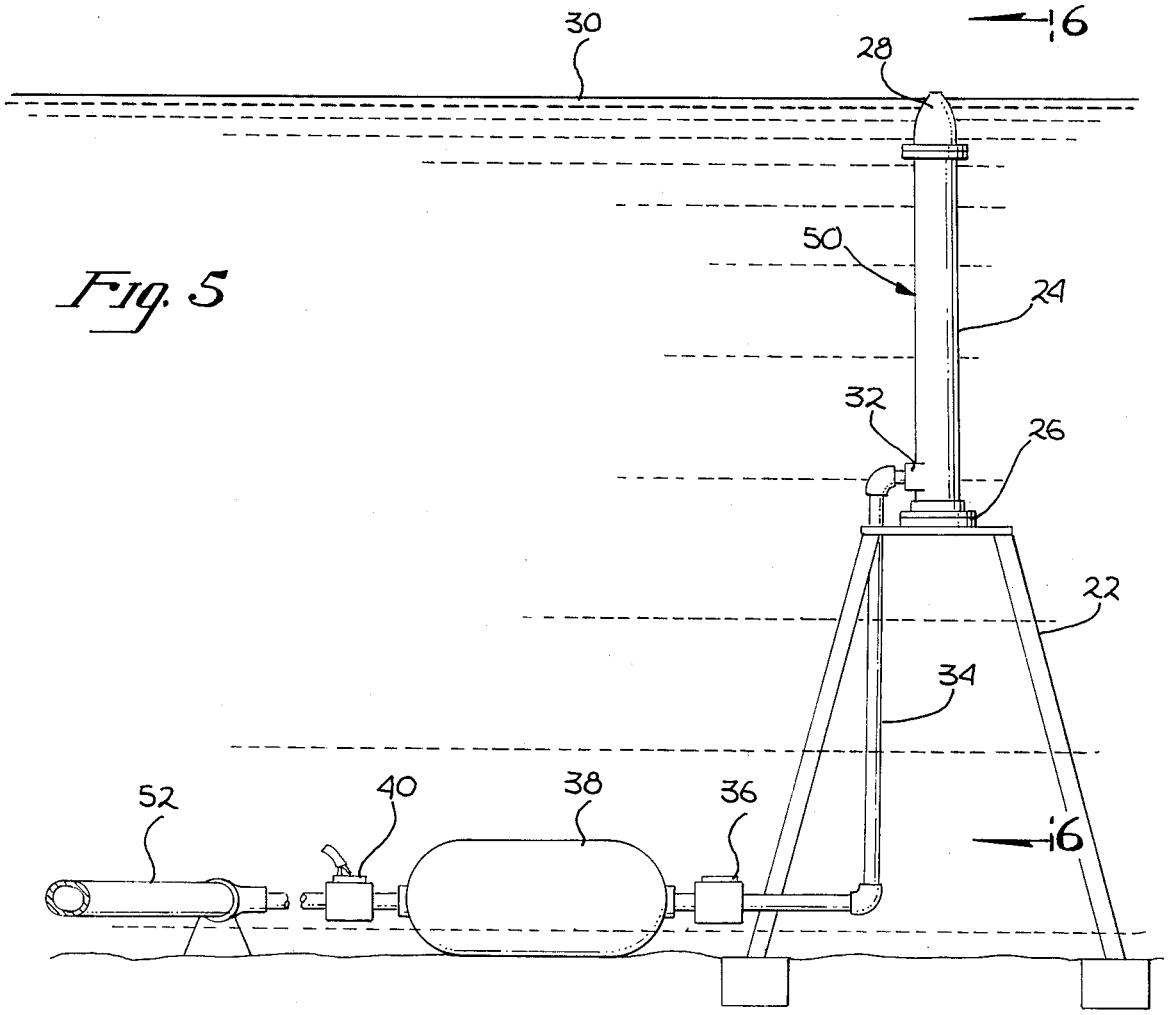
FIG. 5 is a partial cross section taken along line 5—5 of FIG. 4.

Now referring to FIG. 5, an illustration of the structure for providing each high energy transient water stream may be seen For each stream, a support structure 22 is anchored to the bottom or the body of water. Supported on the support structure is a water ejector assembly comprising a vertically oriented section of plastic pipe 24 capped at the bottom 26, and having fastened to the top thereof a nozzle 28, the nozzle projecting just above the surface 30 of the body of water. In one embodiment, the pipe 24 is a 10 foot section of PVC pipe having a 12 inch inner diameter, and having flanges solvent welded to the ends thereof for the bolting on of the nozzle 28 at the upper end thereof, and for bolting on plate 26 capping off the lower end thereof. Cemented adjacent the lower end of member 24 is a pipe connection 32 coupled through appropriate plastic pipe and pipe couplings 34 and through a valve 36 to a compressed air storage tank 38, in turn coupled through valve 40 to supply line 42. As shown in FIG. 5 and elsewhere herein, compressed air storage tank 38 has an inlet as well as an outlet port, though single ported tanks may readily be used with an external T connected thereto to provide dual connections to the port. Of course the compressed air storage tank 38 is properly weighted and attached to the bottom of the body of water, either separately, or as part of the platform 22, as convenient for the particular installation.

Figure 6:
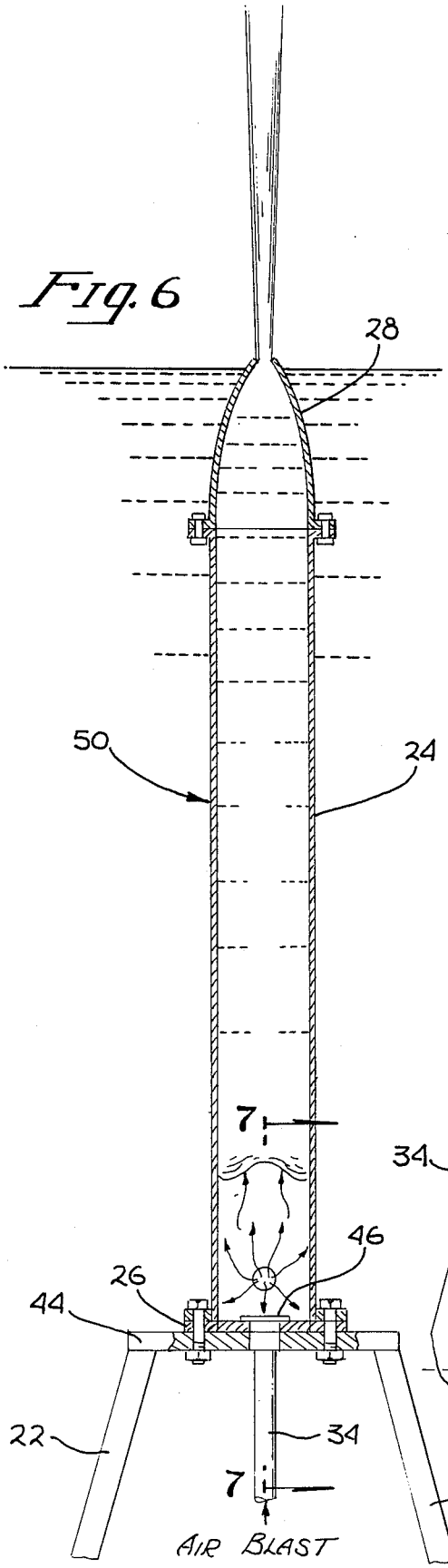
FIG. 6 is a cross section of the water ejector 50 and support structure of FIG. 5.
Figure 8:
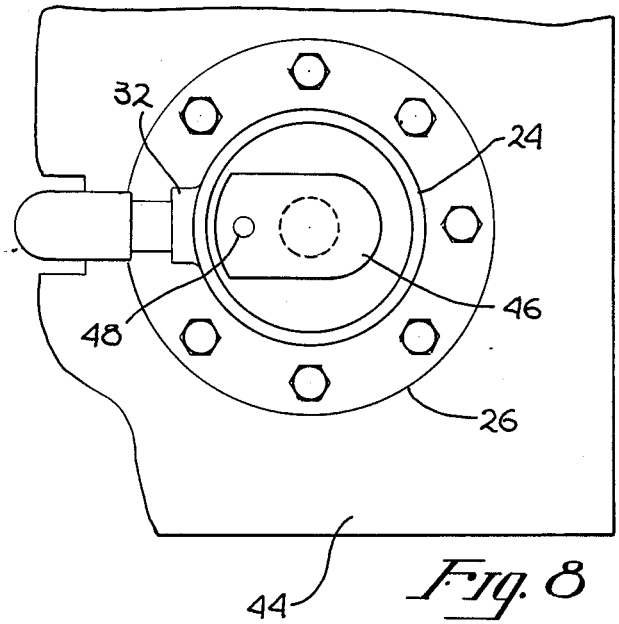
FIG. 8 is a cross section taken along line 8—8 of FIG. 7.
Figure 7:
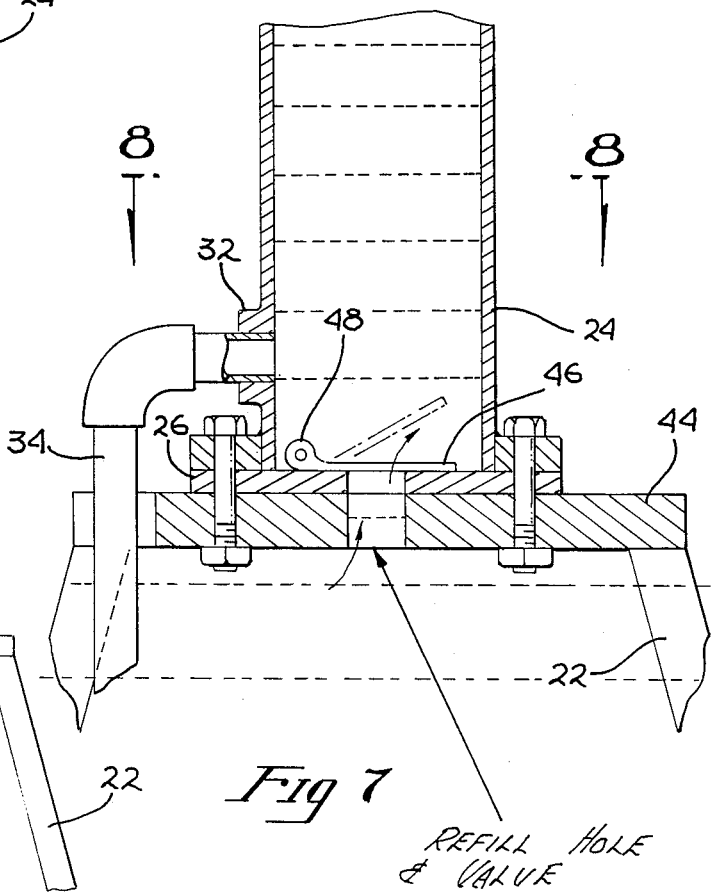
FIG. 7 is a partial cross section taken along line 7—7 of FIG. 6.

Now referring to FIGS. 6, 7, and 8, further details of parts of the assembly of FIG. 5 may be seen. Pipe member 24, as shown in FIG. 6, has flanges welded to each end thereof as previously described which, at the upper end bolts to nozzle 28. While the nozzle may be fabricated in any of various ways, it is convenient to make the same of fiberglass as it is relatively easy to fabricate reusable male molds for hand lay up purposes which will result in both the desired contour and smooth surface finish of the internal geometry of the nozzle. At the other end of pipe 24, not only is cap plate 26 with an appropriate seal thereon bolted to the adjacent flange, but at least some of the bolts extend through plate 44 at the top of support structure 22 to maintain the assembly in the desired orientation and elevation.

Mounted to plate 26 is a simple flapper valve 46, best seen in FIG. 7. The flapper valve preferably is a simple heavier than water plate-like valve member, loosely supported on a hinge rod 48 so as to open to let water into pipe 24 under the influence of the hydrostatic pressure difference between the outside water and any water in the pipe, and to close under the influence of gravity as the pressure differential approaches zero. For this purpose a simple brass flapper valve may be used. Also, as may subsequently be seen, when the water display is fired, the pressure within the respective ejector assembly, generally indicated by the numeral 50 is vented to atmospheric pressure within very few seconds, and during the firing, some water will remain at or fall to the bottom of the assembly. Accordingly, the flapper valve need not perfectly seal when closed, as the amount of water which can escape therefrom during the transient firing period will be small, and less than the amount left in the bottom of the assembly. Of course, other types of check valve type assemblies may also be used, though preferably the back pressure required to open the valve should be low to ensure adequate automatic filling of the ejector assembly with water from the body of water after each firing.

Figure 4:
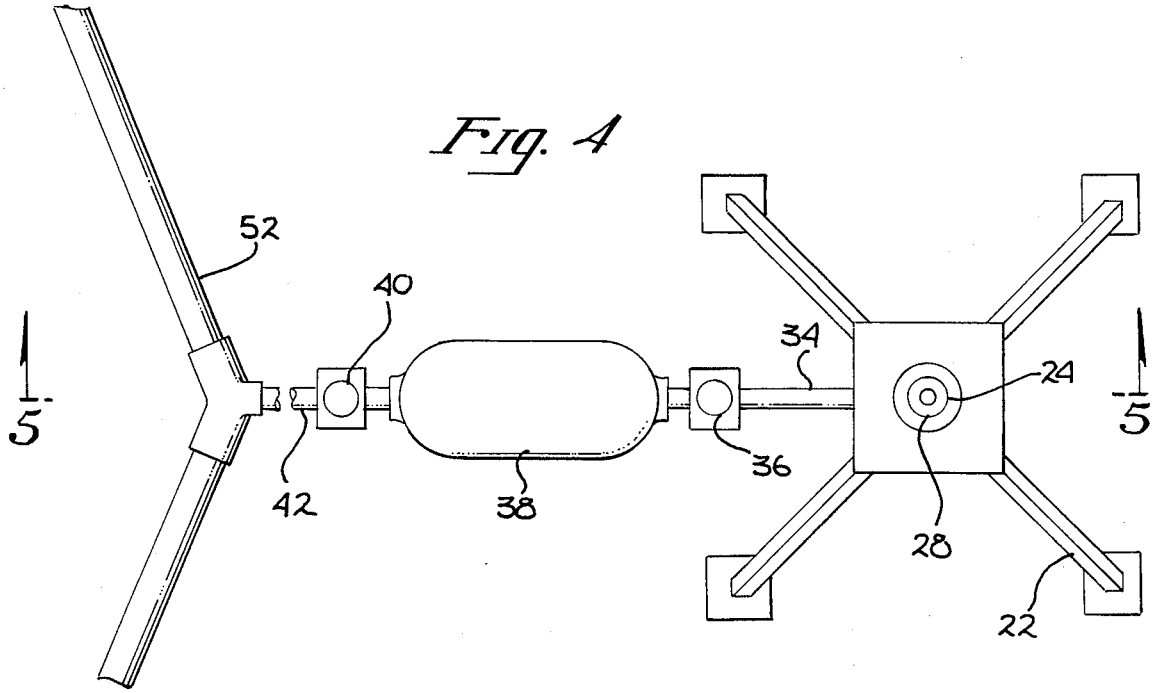
FIG. 4 is a view taken on an expanded scale along line 4—4 of FIG. 3.
Figure 9:
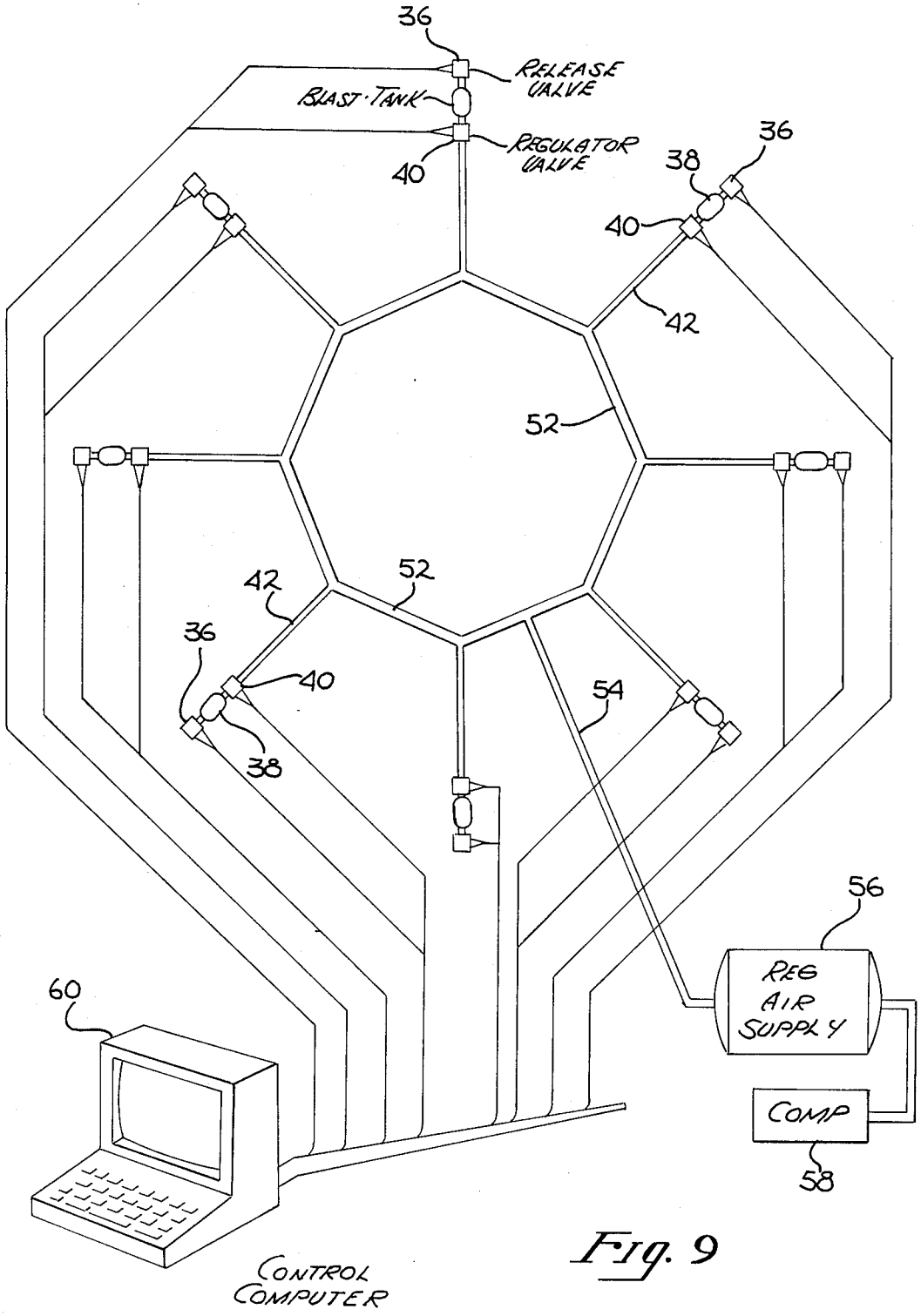
FIG. 9 is a schematic illustration of the overall system of the embodiment of FIGS. 1 through 8 including the control system therefore

Referring now to FIGS. 3 and 4, and incidentally to FIG. 5, further details of a representative installation of the present invention may be seen. In particular, as previously mentioned, each of the compressed air storage tanks 38 are coupled through a valve 40 to lines 42, which in turn are coupled in a ring configuration by lines 52 to a main compressed air supply line 54. As shown in FIG. 9, the main supply line 54 in turn is coupled to a high pressure air storage tank 56 supplied by air pump or compressor 58. Also, as shown in FIG. 9, valves 36 are coupled through an appropriate interface to a personal computer 60 for the control thereof. In that regard, in the preferred embodiment, the valves 36 are solenoid valves and thus are readily operable through an appropriate electrical interface by the computer. Also coupled to the computer are valves 40, which in a preferred embodiment are a type of valve available through a number of manufacturers such as Fairchild Industrial Products Company, and known as a precision air volume booster. These valves are controlled by a control pressure and provide a reproduction of the control pressure with a high volume of flow. Such valves are available not only to provide a one-to-one correspondence between the control pressure and the controlled pressure, but also to provide other ratios such as one-to-four, four-to-one, etc. Accordingly, one can use a considerably lower control pressure to provide a much higher controlled pressure for control by the personal computer 60 utilizing of course a pump 58 and air supply 56 at an equal, or even higher pressure. Current to pressure transducers, readily commercially available, are used to convert the computer output to pressure to control the precision air volume boosters on an individual basis.

Having now disclosed the basic organization of one embodiment of the present invention, the operation thereof will now be described. In the quiescent state, the ejector assemblies 50 will be filled with water through the flapper valve 46 at the bottom thereof (See FIG. 7). To start the system, the air pump or compressor 58 is turned on to provide a supply of compressed air to the storage tank 56 (FIG. 9), the storage tank normally being located near the compressor installed somewhere at the side of the body of water. The computer 60 is also turned on and a simple operating program loaded to control solenoid valves 36 and the air volume boosters 40. In a typical operating sequence of one of the water ejectors 50, the computer will provide a command pressure to the respective booster 40, causing the same to couple air in the supply tank 56 through line 54, lines 52, and the respective line 42 to pressurize the respective storage tank 38 at the commanded pressure. While there is no feedback with respect to when the respective tank 38 reaches the commanded pressure, the respective booster 40 will automatically turn off when that occurs, and the computer itself, if desired, may have a simple look-up table based upon past experience so that the computer itself can determine hen the commanded pressure is reached. Thereafter, when desired, solenoid valve 36 may be triggered, directly coupling the compressed air in the respective one of tanks 38 to the respective water ejector. Because of the low density, low viscosity of the air, and the relatively close coupling of the compressed air storage tank 38 and the respective ejector 50, excellent coupling of the air pressure in the tank through the bottom of the ejector is achieved using a solenoid valve which is smaller than the opening in nozzle 28. In particular, in a preferred embodiment using a three inch nozzle opening, a solenoid valve of 1.5 to 2.0 inches is adequate, though care should be taken to avoid any greater restrictions elsewhere in the line between the valve and the water ejector.

When a solenoid valve 36 is fired, the air pressure in a respective tank 38 is coupled to the bottom of an ejector. As shown in FIG. 6, the net effect is to force the water therein upwards through the nozzle and upward therefrom in a high velocity, relatively well organized stream. In that regard, while some of the water in the ejector assembly 50 passes through the air to collect at the bottom thereof during firing, it has been found that even in a prototype assembly having the 3 inch nozzle with a 12 inch inner diameter pipe 24, approximately two thirds of the water in the pipe is in fact ejected through the nozzle before the high pressure air reaches the nozzle region. Obviously, a much higher percentage could be ejected if a much smaller tube extended from the nozzle toward the bottom of the pipe 24, and the high pressure air was injected into the pipe 24 near the top thereof to force the water between the inner wall of the pipe and the outer diameter of the smaller tube downward under the bottom of the tube and then upward through the tube. Such an arrangement however, is not preferred, as it is somewhat more complicated to construct, and the viscous effects of the high velocity stream through the tube would cause substantial energy loss, and a much less effective water display. More particularly, the flow through the tube would develop fairly well, so that the ultimate stream ejected would have high velocity only at the center thereof, with the velocity decreasing to a very low value at the periphery of the stream, whereby the resulting stream would project upward only a small fraction of the head represented by the air pressure ducted to the ejector. Thus, while such an arrangement would increase the efficiency of the ejector in terms of percentage of water ejected, it would very substantially decrease the energy in the ejected stream and the height that the same attains. In that regard, in a prototype unit, stream heights are attained which represent a very substantial fraction of the potential head available, reaching heights of 150 feet and more dependent upon the pressure used. This is the result of a relatively short nozzle which minimizes the effects of viscosity on the stream emitted thereby. In that regard, even a simple sharp edged orifice could be used, further reducing the viscous effects.

In the prototype water displays, the water would be ejected and the high pressure air in the pipe 24 of the ejector assembly would be vented to atmosphere in approximately 1–2 seconds. Accordingly, the triggering of a respective solenoid valve 36 need only be for a period of 1–2 seconds, as thereafter the energy in the compressed air is simply lost. This too determines the size of the storage tank 38, in that while a tank size of the same order of magnitude as the internal volume of pipe 24 is desired, there is little purpose in using a very much larger tank, as some drop in pressure during the firing of the water display is not of great consequence, provided the initial pressure causes the water stream to attain the desired altitude.

The program for firing a plurality of water ejectors such as the eight shown in the FIGS. 1 through 9 may take various forms as desired. By way of example, one could decide what the lowest and highest streams, and thus the lowest and highest pressures desired might be, and for each firing, have the computer select at random, a pressure between these two limits for the next firing of the respective water ejector Similarly, the time between firings may be made random between appropriate time limits, and for that matter, the firing of the water ejector may be sequential or other than sequential, as desired. Further, at times one might avoid simultaneous firing of two water ejectors, though at other times two or more may be fired simultaneously using the same or different pressures, as desired. Further, one can also make the delay between firings of a given water ejector dependent on or even directly proportional to the height being attained, so that an observer's anticipation would build based on the delay between firings. In that regard, the preferred approach is more a question of individual preference, with perhaps a mixture of approaches providing the greatest continuing observer appeal. Since the operation of the system is based on a series of individual occurrences which in terms of typical computer speed, are only updated on quite an infrequent basis, the control program may readily be written in a relatively slow, high level language such as Basic, as the time delays between occurrences would still well exceed the computational time required.

The embodiment of the invention disclosed in FIGS. 1 through 9 illustrates one of the very important advantages of the present invention. In particular, since each firing of a water ejector is a transient occurrence lasting at most typically only a few seconds, the instantaneous power represented by each water stream ejected may exceed the continuous power of compressor 58 by an order of magnitude or more By way of specific example, in one embodiment a water stream which in the steady state would require a 20,000 horsepower pump can be achieve with sufficient frequency using an air compressor of only a few hundred horsepower.

Figure 10:
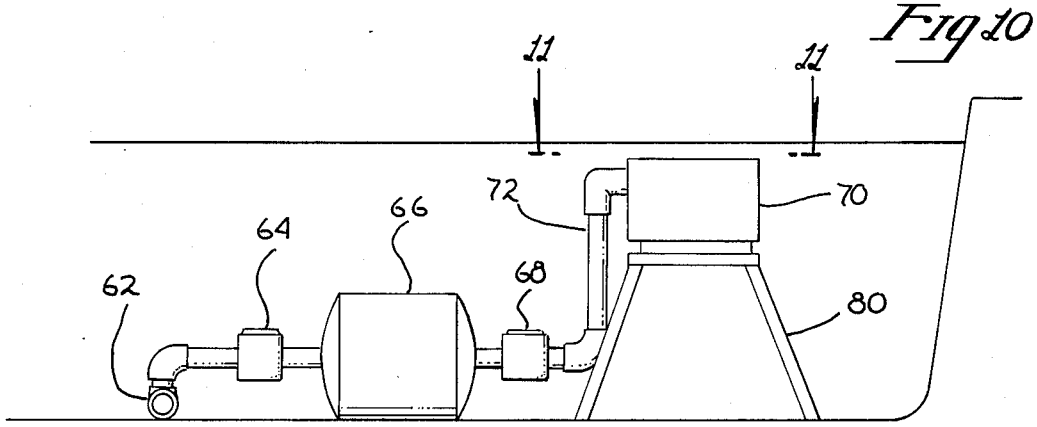
FIG. 10 is a side view of an alternate embodiment of the present invention.
Figure 11:
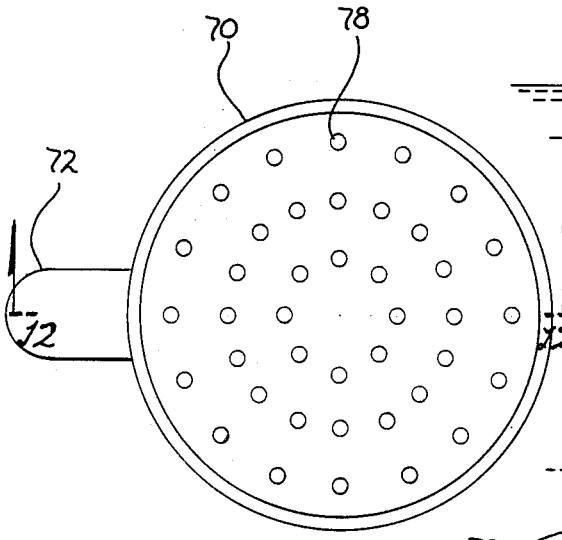
FIG. 11 is a top view taken along line 11—11 of FIG. 10.
Figure 12:
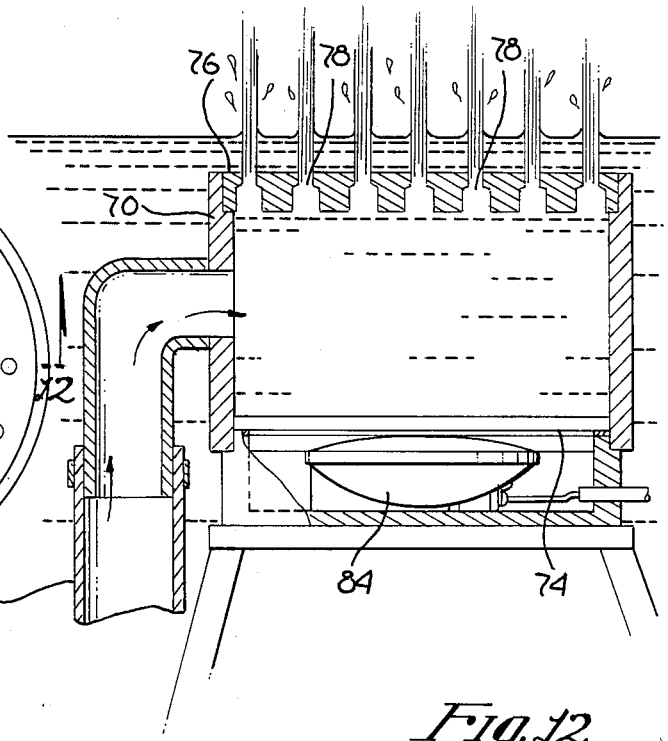
FIG. 12 is a partial cross-section taken along line 12—12 of FIG. 11.

Now referring to FIGS. 10 through 12, an alternate embodiment of the present invention may be seen. Here, air is supplied from a compressor (not shown) through line 62 and controllable valve 64 to the compressed air storage tank 66 which, through solenoid valve 68, may provide the high pressure air in tank 66 to the water ejector. The water ejector itself in this embodiment however, is substantially different from that of the earlier described embodiment. In particular, a shorter cylindrical enclosure 70 fed through line 72 by solenoid valve 68 is used. Thus line 72 not only couples the high pressure air to the enclosure 70, but actually forms part of the enclosure, itself filling with water between firings of the display. As may be best seen in FIG. 12, the enclosure 70 has a bottom solid transparent plate 74 and a top transparent (or opaque if preferred) nozzle plate 76, the nozzle plate 76 having a plurality of openings 78 therein through which water under pressure may be ejected. In that regard, it is to be understood that the word nozzle as used herein is used in a general sense to define an opening through which water under pressure may be ejected in a stream, and may include nozzles which provide substantially laminar flow, nozzles which provide a flow deviating substantially from laminar flow, orifices or other such openings. In that regard, the openings 78 shown in FIG. 12 are holes drilled through plate 76, which in turn are drilled part way through with a larger drill to reduce the length of the shorter holes and thus the viscous loses in the water passing therethrough. This entire assembly is positioned on a support structure 80 (see FIG. 10) so that the top surface of the nozzle plate 76 is somewhat below the water level 82 of the body of water in which it is located, typically in this embodiment a pond or pool of a more typical fountain pool size.

As stated before, line 72 will also fill with water between firings as a result of the water in the body of water flowing into the assembly through the openings in the nozzle plate 76. While the line 72 should have a sufficient diameter to not restrict the airflow from tank 66 during the periods solenoid valve 68 is open, the line 72 may in fact be larger or longer as might otherwise be required to provide increased water storage capacity, as this is the primary source of the water ejected through the openings in nozzle plate 76 during the firing of the display. Note also that not only does line 72 contain much of the water which is ejected during firing of the display, but that it does so in an "off axis" manner. The net result is that the enclosure 70 remains completely filled with water during the firing until just before the pressurized air is vented through the openings in the nozzle plate 76. Because of the absence of air bubbles in the enclosure 70 and/or an irregular water-air interface therewithin, the same provides an efficient light transmitter whereby light source 84 positioned below the bottom plate 74 closing the bottom of enclosure 70 may project light upward through the water streams as well as through the clear plastic nozzle plate 76. In that regard, since the top cf the nozzle plate 76 is located below the top 82 of the body of water in which it is located, the individual water streams will entrain a substantial amount of water out of the body of water essentially creating a dynamic torch-like display, typically lighted only during the period of the display.

Obviously the embodiment of FIGS. 10 through 12 may also be positioned so that the nozzle plate 76 is just above the surface of the water. In this case, the water would rise from the nozzle plate in individual, well defined streams, whereas if positioned under the surface of the water, the entrainment of water from the body of water, typically more pronounced in the peripheral streams than in the central streams, will provide the bush-like display, the full characteristics of which will depend upon the pressure used, the depth below the surface of the water the nozzle plate is positioned, etc. Obviously, if not positioned under the surface of the water, a flapper or other type of freely operating check valve would be used, as with the earlier described embodiment, to provide for the automatic refilling of the display, through of course some form of power refilling could be used depending upon the specific application and the preference of the designer.

Figure 13:
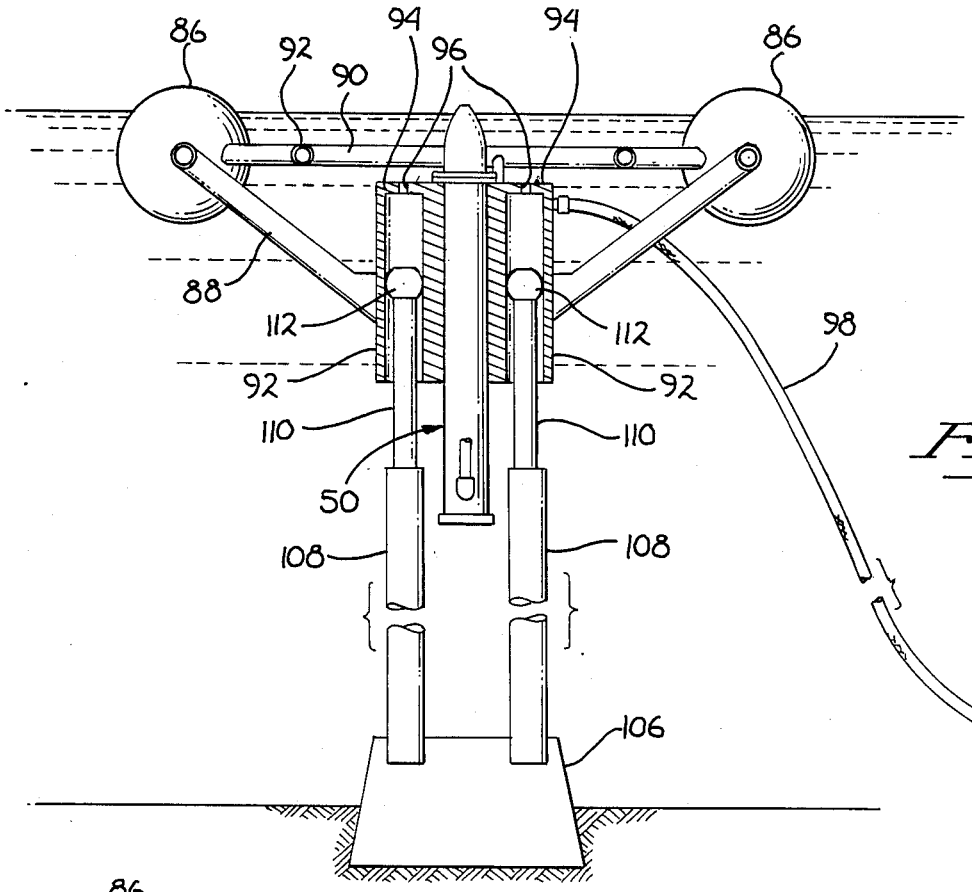
FIG. 13 is a side view of a still further alternate embodiment.
Figure 14:
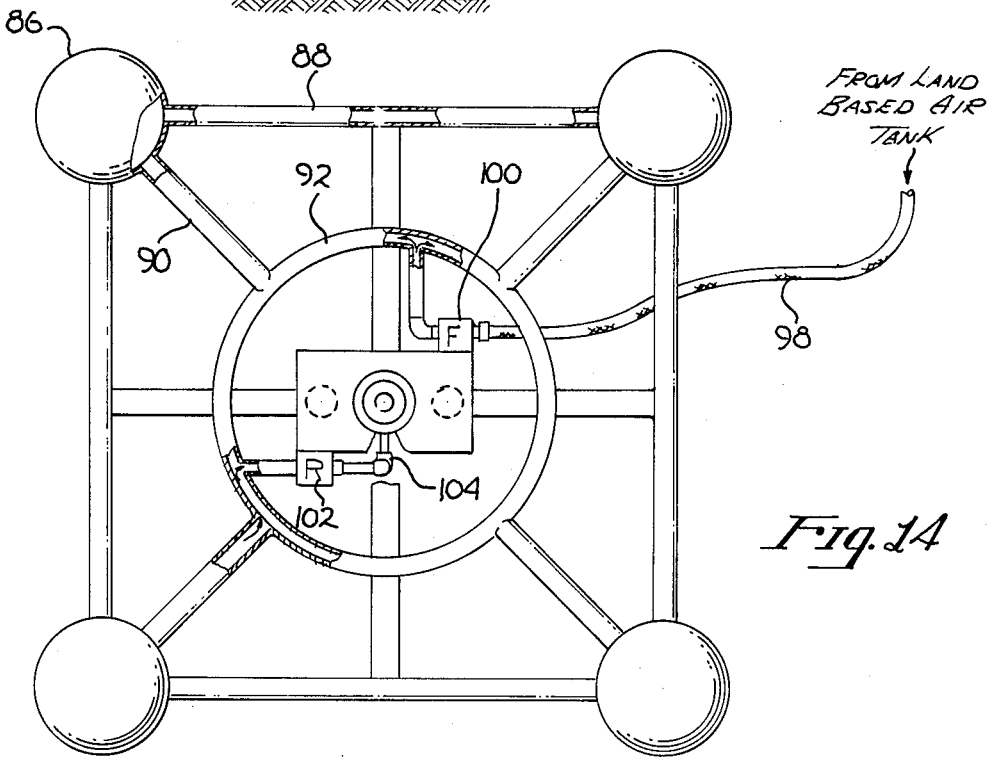
FIG. 14 is a top view of the embodiment of FIG. 13.

Now referring to FIGS. 13 and 14, a still further alternate embodiment of the present invention may be seen. This embodiment is intended for use in lakes and other natural bodies of water wherein the depth of the water may vary because of seasonal, tidal or other effects. For this purpose, a plurality of combined location and compressed air storage tanks 86 are coupled together through a structure comprising members 88 and 90, with members 90 providing compressed air communication between the associated storage tank 86 and manifold 92. Supported on this structure is an ejector assembly 50, which may be identical to the ejector assembly 50 hereinbefore described with respect to the embodiment of FIGS. 1 through 9. Mounted to the ejector assembly 50 and the float structure is an additional pair of tubular members 92 capped at the top thereof by caps 94, each of which has a small vent 96 therein.

Air is supplied to the assembly through line 98 from an onshore air compressor (not shown), with a controllable valve 100 coupling and decoupling manifold 92 from line 98 as desired. This valve may be an ordinary solenoid valve, or as one alternative, may be the precision air volume booster hereinbefore mentioned. Also connected to manifold 92 is a solenoid valve 102 coupled through line 104 to a position adjacent the bottom of the ejector 50 for operation thereof as hereinbefore described.

The entire floating assembly hereinbefore described is retained in position by an appropriate structure anchored to the bottom of the body of water. The anchoring thereof may vary from installation to installation, depending upon the bottom of the lake, etc. By way of example, one might use pilings driven into an otherwise relatively soft lake bottom or, as shown in FIG. 13, a concrete base 106 may be used as a rocky or otherwise stable lake bottom permits. Extending upward from the lake bottom are a pair of vertical members 108, in the embodiment shown in FIG. 13 and 14, supporting somewhat smaller vertical members 110 extending upward into the tubular members 92 and having a spherical end portion 112 thereon having a loose slip fit within the tubular members. In this manner, the floating assembly will automatically adjust in elevation to the current level of the lake, moving up and down on the spherical numbers 112 as the lake level changes. When positioned in a lake which may include speed boats and other wave generation phenomena, the entire floating assembly may rock somewhat in response thereto without binding between the cylinder comprising tubular numbers 92 and the pistons therein comprising the spherical members 112. When the water ejector is fired however, the spherical members 112 act as pistons within the tubular members absorbing the downward force resulting from the firing and only allowing a slight downward movement of the floating assembly during the short duration of the firing. Thus, the floating assembly may readily seek its own level in response to changes in the level of the lake, though will not move downward significantly during the firing thereof.

Finally of course, the water streams resulting in the embodiment of FIGS. 1 through 9 and 13 and 14 may also be illuminated, either with white light or with colored light, as desired, which would provide a spectacular night time display of unusual scale. Here however, light from the bottom of the water ejector 50 is not preferred, in part because without focusing only a small part of that light would be directed out the nozzle opening as desired, and even if initially directed as desired, the irregular air-water interface during firing, and the bubbles of air in the water and drops of water in the air adjacent the air-water interface would so disperse the light as to provide a very low efficiency of light transmission in the desired mode. Instead however, preferably light from a source external to the enclosure of the water ejector could be focused into a fiberoptic bundle, the other end of which extends into the pipe 24 and is positioned axially just below nozzle 28 to direct most of the light emitted thereby upward into the water stream.

While the fiberoptic bundle would need to be reasonably well supported within pipe 24, nozzle 28 may be kept relatively short, providing reasonable efficiency in directing the light along the axis of the water stream, even with the end of the fiberoptic bundle not extending significantly into the nozzle. By way of example, for the 3 inch nozzle, if the fiberoptic bundle terminated in a region where the diameter in the nozzle was approximately 6 inches, the flow area in that region would be approximately 4 times that of the nozzle outlet, giving an average water velocity of one fourth of that in the nozzle outlet, or a dynamic pressure of only 1/16th of that in the nozzle outlet. Thus, even if the dynamic pressure in the outlet stream in the nozzle was 160 PSI, the dynamic pressure in the region of the end of the fiberoptic bundle would only be 10 PSI, and of course much less than this in the regions therebelow.

There has been disclosed and described herein, new and unique air powered water displays which allow the creation not only of interesting new dynamic water displays, but also the creation of such a display on a scale which is not practical to achieve utilizing ordinary water pumps and the like. While two embodiments of the invention have been disclosed and described herein, it will be understood by those skilled in the art that various changes in form and detail may be made therein without departing from the spirit and scope of the invention.

We claim:

1. A water display comprising:

a body of water;

a pressure resistant enclosure disposed at least in part within said body of water, said pressure resistant enclosure having at least one nozzle coupled to the upper end thereof for directing water delivered thereto under pressure upward in at least one stream, said nozzle being disposed near the surface of said body of water;

a compressed air storage tank;

first valve means coupled between said compressed air storage tank and a lower portion of said pressure resistant enclosure for controllably coupling compressed air from said compressed air storage tank to said lower portion of said pressure resistant enclosure;

air-compressor means coupled to said compressed air storage tank for increasing the air pressure therein, and;

control means for controlling said first valve means to couple compressed air from said compressed air storage tank to said lower portion of said pressure resistant enclosure to eject at least a substantial part of the water therein upward through said nozzle in a transient, high energy water stream.

2. The water display of claim 1 further comprised of means for automatically refilling said pressure resistant enclosure with water from said body of water when said enclosure is unpressurized.

3. The water display of claim 2 wherein said means for automatically refilling said pressure resistant enclosure comprises means for disposing said at least one nozzle slightly below water level in said body of water, whereby said pressure resistant enclosure will refill by water passing therein through said nozzle.

4. The water display of claim 2 wherein said means for automatically refilling said pressure resistant enclosure comprises second valve means adjacent to bottom of said pressure resistant enclosure.

5. The water display of claim 4 wherein said second valve means is responsive to a differential pressure across said second valve means due to pressurization of said pressure resistant enclosure to remain closed, and is responsive to an opposite differential pressure to allow water to flow from said body of water into said pressure resistant enclosure.

6. The water display of claim 1 further comprised of illumination means for directing light upward through said nozzle.

7. The water display of claim 1 further comprised of pressure setting means for setting the pressure in said compressed air storage tank prior to coupling the same through said first valve means to said pressure resistant enclosure.

8. The water display of claim 7 wherein said pressure setting means is coupled to said control means, whereby said control means may control and vary the height of the transient water stream and the time duration between operations of the water display.

9. The water display of claim 8 wherein said pressure setting means is a third valve means coupled between said compressor means and said compressed air storage tank and responsive to a control signal from said control means and to the pressure in said compressed air storage tank to close said third valve means when the pressure in said compressed air storage tank reaches the pressure corresponding to said control signal.

10. The water display of claim 1 further comprising flotation means for floating on the surface of said body of water, said pressure resistant enclosure being coupled to said flotation means to rise and fall therewith as the level of the water in said body of water rises and falls.

11. A method of creating a high energy water display comprising the steps of:

(a) providing a pressure resistant enclosure having at least one nozzle coupled to the upper end thereof for directing water delivered thereto under pressure in at least one stream;

(b) providing a compressed air storage means;

(c) filling the pressure resistant enclosure with water, and filling the compressed air storage means with air under pressure, and;

(d) directly coupling the compressed air storage means to the pressure resistant enclosure at a location at least near the bottom thereof placed air being discharged from said air storage means in direct fluid communication with the water in the pressure resistant enclosure to expel at least a substantial part of the water in the pressure resistant enclosure thereabove through said at least one nozzle in direct response thereto.

12. The method of claim 11 wherein steps (c) and (d) are repeated numerous times.

13. The method of claim 12 wherein the frequency with which steps (c) and (d) are repeated is varied.

14. The method of claim 12 wherein in step (c), the pressure of the air in the pressure resistant enclosure is varied between repetitions.

15. The method of claim 14 wherein the frequency with which steps (c) and (d) are repeated is also varied.

16. The method of claim 11 further comprised of the step of lighting the water expelled through said at least one nozzle from within the pressure resistant enclosure during the occurrence of step (d).

17. A water display comprising:

a pressure resistant substantially tubular enclosure having at least one nozzle coupled to the upper end thereof for directing water delivered thereto under pressure upward in at least one stream;

a compressed air storage tank;

first valve means coupled between said compressed air storage tank and a lower portion of said pressure resistant enclosure for controllably coupling compressed air from said compressed air storage tank to said lower portion of said pressure resistant enclosure;

air compressor means coupled to said compressed air storage tank for increasing the air pressure therein, and;

control means for controlling said first valve means to couple compressed air from said compressed air storage tank to said lower portion of said pressure resistant enclosure to eject at least a substantial part of the water therein upward through said nozzle in a transient, high energy water stream.

18. The water display of claim 17 further comprised of means for automatically refilling said pressure resistant enclosure with water when said enclosure is unpressurized.

* * * * *

UNITED STATES PATENT AND TRADEMARK OFFICE

CERTIFICATE OF CORRECTION

PATENT NO. : 4,852,801

DATED : 08/01/89

INVENTOR(S) : Fuller et. al.

It is certified that error in the above-identified patent and that said Letters Patent is hereby corrected as shown below:

| | |
|---|---|
| col. 02, line 59 | delete "through" insert --though-- |
| col. 03, line 12 | delete "or" insert--of-- |
| col. 06, line 42 | delete "achieve" insert --achieved-- |

Signed and Sealed this

Twenty-fifth Day of December, 1990

*Attest:*

HARRY F. MANBECK, JR.

*Attesting Officer*

*Commissioner of Patents and Trademarks*